US008726440B2

(12) United States Patent
Bolduan et al.

(10) Patent No.: US 8,726,440 B2
(45) Date of Patent: May 20, 2014

(54) METHOD AND DEVICE FOR DETERMINING THE OPTIMAL ROTATIONAL SPEED OF A DRUM OF A LAUNDRY TREATMENT DEVICE

(75) Inventors: Edwin Bolduan, Berlin (DE); Gundula Czyzewski, Berlin (DE); Harald Moschütz, Groβbeeren (DE); Ingo Schulze, Panketal (DE); Horst Wiemer, Kleinmachnow (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 971 days.

(21) Appl. No.: 12/744,689

(22) PCT Filed: Oct. 28, 2008

(86) PCT No.: PCT/EP2008/064570

§ 371 (c)(1),
(2), (4) Date: May 26, 2010

(87) PCT Pub. No.: WO2009/068386

PCT Pub. Date: Jun. 4, 2009

(65) Prior Publication Data

US 2010/0251487 A1 Oct. 7, 2010

(30) Foreign Application Priority Data

Nov. 28, 2007 (DE) ..... 10 2007 057 331

(51) Int. Cl.
*D06F 33/00* (2006.01)

(52) U.S. Cl.
USPC ..... 8/159; 68/12.02; 68/23.1

(58) Field of Classification Search
CPC ... D06F 37/04; D06F 37/203; D06F 35/0063; D06F 35/006; D06F 33/02
USPC ..... 8/159; 68/12.02, 12.04, 23.1
See application file for complete search history.

(56) References Cited

U.S. PATENT DOCUMENTS 5,560,061 A 10/1996 Wentzlaff et al.
5,671,494 A * 9/1997 Civanelli et al. ..... 8/159

(Continued)

FOREIGN PATENT DOCUMENTS

DE 1262202 3/1968
DE 3436786 A1 4/1986

(Continued)

OTHER PUBLICATIONS

Machine Translation—DE10326551 A1.*

(Continued)

*Primary Examiner* — Michael Kornakov
*Assistant Examiner* — Marc Lorenzi
(74) *Attorney, Agent, or Firm* — Nixon & Vanderhye, P.C.

(57) ABSTRACT

A method for determining a target rotational speed below an application rotational speed of a washing drum of a laundry treatment device having a drive and a vibrating system, wherein a dependence of a mechanical effect on items to be washed located in the washing drum on the respective nominal speed of the washing drum is used to ascertain the target rotational speed at which the mechanical effect is at the greatest. The mechanical effect at a respective target rotational speed is ascertained by measuring vibrating system movements of the vibrating system which exhibit greater frequency than the respective target rotational speed. The rotational speed at which the maximum vibrating system movement was measured is selected for carrying out the washing care procedure. The advantage of such a method is that the washing mechanics can be increased, thus improving the cleaning efficiency.

11 Claims, 1 Drawing Sheet

(56) References Cited

U.S. PATENT DOCUMENTS

| | | | | |
|---|---|---|---|---|
| 6,134,926 | A * | 10/2000 | Vande Haar et al. | 68/12.06 |
| 2002/0016997 | A1 * | 2/2002 | Jonsson | 8/159 |
| 2002/0078718 | A1 * | 6/2002 | Wiemer et al. | 68/208 |
| 2005/0016226 | A1 * | 1/2005 | Okazaki et al. | 68/12.04 |
| 2008/0134447 | A1 * | 6/2008 | Schulze | 8/159 |

FOREIGN PATENT DOCUMENTS

| | | | |
|---|---|---|---|
| DE | 4438760 | A1 | 5/1996 |
| DE | 19619603 | A1 | 11/1997 |
| DE | 10054947 | A1 | 5/2002 |
| DE | 10217009 | C1 | 10/2003 |
| DE | 10326551 | A1 * | 1/2005 |
| FR | 2655363 | A1 * | 6/1991 |
| GB | 2253215 | A | 9/1992 |

OTHER PUBLICATIONS

Machine Translation—FR2655363 A1.*

* cited by examiner

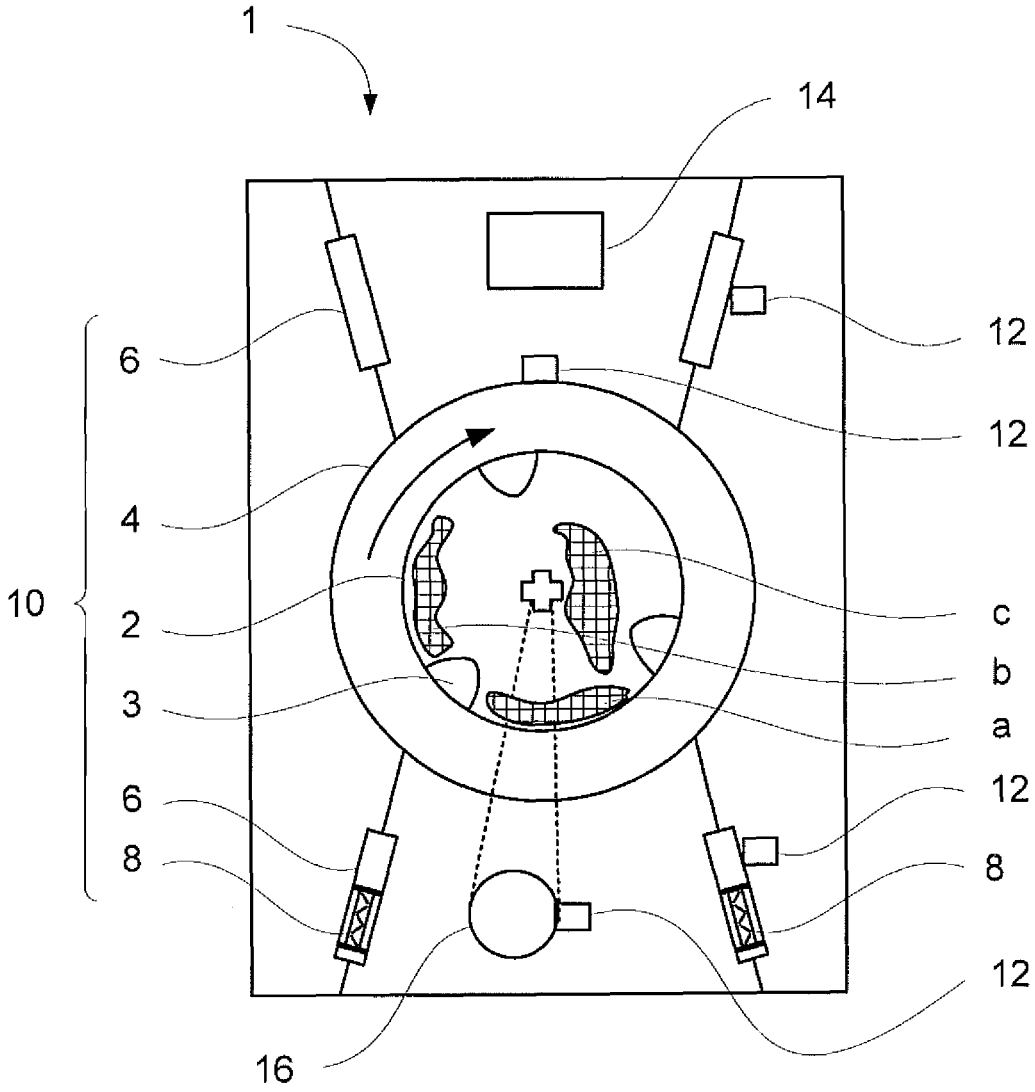
1
14
12
12
6
4
10
2
3
c
b
a
6
8
12
8
12
16

METHOD AND DEVICE FOR DETERMINING THE OPTIMAL ROTATIONAL SPEED OF A DRUM OF A LAUNDRY TREATMENT DEVICE

This application is U.S. National Phase of International Application No. PCT/EP2008/64570, filed on Oct. 28, 2008 and claims priority to German Patent Application No. 102007057331.8, filed on Nov. 28, 2007, the entire contents of each which are hereby incorporated by reference.

BACKGROUND OF THE INVENTION

The present invention relates to a method for determining a target rotational speed below the application rotational speed of a washing drum, as well as a method for treating laundry by using the aforementioned method. The invention further relates to a laundry treatment device which is provided with a control element for carrying out the method according to the invention.

Washing and/or rinsing methods are already known from the prior art for automatic washing machines in which, for improving the washing effect, the washing drum during the washing and rinsing process is driven intermittently at alternating rotational speeds and in alternating rotational directions. Such a method is disclosed in EP 0 618 323 A1. In this method, the laundry is intended to absorb water during the washing or rinsing operation at a rotational speed which is considerably below the so-called application rotational speed, in which the laundry is forced against the drum wall by centrifugal force. As a result of this low rotational speed, it is intended that the laundry is wetted as thoroughly as possible. During operation at a rotational speed which is considerably above the application rotational speed, the absorbed water is intended to be driven out of the laundry again. This method is also known as washing-spinning.

Washing drums are also available which are provided with a scoop device. If such a scoop device is present, the rotational speed and the rotational direction are selected such that the scoop device additionally assists the water absorption of the laundry. Thus, in this known method thorough wetting of the laundry is achieved. This method is disadvantageous, in particular, with large laundry loads. In this case only weak washing mechanics are exerted on the laundry. During operation of the washing drum at rotational speeds which are considerably below the application rotational speed, the laundry executes a so-called rolling motion. The washing mechanics, consisting of compression and friction between the individual laundry items is considerably reduced in the aforementioned method of EP 0 618 323 A1 when operated at rotational speeds considerably below the application rotational speed. When the washing drum is driven above the application rotational speed, the washing mechanics are entirely absent as the individual items of the laundry adhere firmly to the washing drum wall.

Based on the aforementioned method, in the prior art attempts have already been made to increase the washing mechanics by the preselection of set, variable rotational speeds. Improved washing mechanics are desirable, in particular, with non-delicate laundry as otherwise too little cleaning effect is achieved and an optimal washing result may not be achieved.

In DE 103 26 551 A1 it is, therefore, proposed within the washing and/or rinsing process to drive the washing drum in at least one phase of intensive wetting of the laundry and in at least one phase of high washing mechanics. These phases succeed one another at least once within the washing and/or rinsing process. In the phase of intensive wetting of the laundry, the speed of the washing drum is changed in one direction to a rotational speed considerably above the application rotational speed and in the other direction to a second rotational speed considerably below the application rotational speed. In the phase of high washing mechanics, the washing drum is accelerated in both rotational directions to rotational speeds at which the individual laundry items are strongly compacted and are rubbed vigorously against one another. However, a method is not disclosed by which the optimal rotational speeds for the aforementioned phases are determined for one respective washing program, one respective type of laundry and one respective load.

In DE 196 19 603 A1 it is proposed to tackle variable load quantities and the resulting different degrees of mechanical washing effects at a fixed rotational speed, by the rotational speed being alternately increased or reduced, depending on the respective position of the entrainers. In this case, however, as before there is the drawback that the alteration of the rotational speed is not dependent on the different loads.

BRIEF SUMMARY OF THE INVENTION

The object of the present invention is to provide a method by which the respective optimal rotational speed for the greatest possible washing mechanics is determined and may be used for any load and any washing program.

This object is achieved by a method for determining a target rotational speed (n) below an application rotational speed of a washing drum (2) of a laundry treatment device (1) having a drive (16) and a vibration system (10), a dependence of a respective mechanical effect on laundry (3) located in the washing drum (2) on the respective target rotational speed (n) of the washing drum (2) being used to ascertain the target rotational speed (n) at which the mechanical effect is at the greatest.

Preferably, the method comprises the following steps:

i) driving the washing drum (2) at least two different target rotational speeds (n1 to nx) below the application rotational speed for one respective predetermined time period ($\Delta$tn)

ii) measuring a vibration system movement value (s1 to sx) at each target rotational speed (n1 to nx), iii) comparing the values (s1 to sx) with one another, determining the highest value (s) and determining the target rotational speed (n) which is associated with the highest vibration system movement value (s).

During a conventional washing and/or rinsing process, the washing drum, which generally operates in a reversible manner, is operated at a so-called washing rotational speed, which for conventional washing machines is approximately 55 $min^{-1}$. This rotational speed is determined empirically once during the development of the appliance and set in the washing program. If the washing drum is thus loaded with laundry, optionally wetted and driven at the washing rotational speed, it should result in a specific mechanical effect.

The expression "laundry" in the sense of the present invention firstly encompasses textiles, in particular laundry, but also generally any items which may be treated in a conventional washing machine.

By the term "washing mechanics" or "mechanical effect" is understood the forces which act on the laundry if the washing drum is moved. In particular, a process is understood thereby in which the laundry items are driven and lifted by the entrainers arranged in the washing drum and, as soon as they have reached a sufficiently high point by the rotation of the drum that they are no longer held by the entrainers, fall down again. The striking of the falling laundry items onto laundry items located at the bottom or even the surface of the detergent solution has a good cleaning effect and is similar to a churning process. The rotational speed at which the laundry items are subjected to the greatest washing mechanics, disclosed above, is the rotational speed which is determined in the method according to the invention.

As already mentioned, during operation a washing drum is operated at a predetermined target rotational speed (approximately 55 $min^{-1}$). The actual rotational speed, however, fluctuates according to the type and quantity of the load. Moreover, laundry falling during the rotation of the washing drum causes not inconsiderable deflections on the spring-mounted vibration system.

By "vibration system" of a washing machine is understood the drum, the associated detergent solution container as well as the springs and dampers on which the detergent solution container is suspended. The intensity of the washing mechanics thus correlates with the intensity of the vibration system movement.

Surprisingly, it has been shown that it is possible to measure the vibration system movements at target rotational speeds below the application speed sufficiently accurately that conclusions may be made therefrom about the washing mechanics. By measuring the vibration system movement of the laundry care process, generally during washing or even during rinsing, with suitable sensors at different target rotational speeds n1-nx within a range which is below the application rotational speed, the optimal washing rotational speed may be determined for the respective load and the respective washing program and optionally accordingly reset in each program sequence.

The method according to the invention thus preferably comprises the additional step of moving the drum at the previously determined target rotational speed n, at which the greatest possible mechanical effect is achieved on the laundry. Thus the present invention also provides a laundry treatment method by which laundry may be washed or dried or treated in any other manner with the greatest possible mechanical effect.

For the aforementioned method according to the invention, at least two target rotational speeds are predetermined, preferably at least three (n1, n2 and n3), even more preferably at least four (n1, n2, n3 and n4). The predetermined target rotational speeds should be distributed over an advisable range, which for conventional washing machines is in the range of 20 to 80 $min^{-1}$, care always having to be taken that the target rotational speeds relevant for the method according to the invention are below the respective application rotational speed. Predetermined target rotational speeds may, for example, be selected from the following: 20 $min^{-1}$, 25 $min^{-1}$, 30 $min^{-1}$, 35 $min^{-1}$, 40 $min^{-1}$, 45 $min^{-1}$, 50 $min^{-1}$, 55 $min^{-1}$, 60 $min^{-1}$, 65 $min^{-1}$, 70 $min^{-1}$, 75 $min^{-1}$ and 80 $min^{-1}$.

In order to be able to exploit the possible range of target rotational speeds below the application rotational speed as fully as possible, in the method according to the invention it may also be provided initially to determine the application rotational speed for all laundry items for one respective load. This may take place according to conventional methods or be estimated on the basis of the load and empirical values.

As the highest predetermined target rotational value for measuring the vibration system movement, a target rotational value is selected which is slightly below the application rotational speed.

For determining the desired optimal target rotational speed, therefore, the drum loaded with laundry to be treated is operated at a first target rotational speed n1 for a predetermined time period Δtn. The vibration system movement is measured during this time period, or within this time period, for a further predetermined time period Δts by means of sensors associated with the vibration system. From this measurement which may also consist, as disclosed below, of a plurality of measuring points or a continuous measurement, a vibration system movement value s1 for the first target rotational speed n1 is determined and assigned thereto. Subsequently, the drum is operated at a second target rotational speed n2 and, in turn, a vibration system movement value s2 is allocated. These steps are carried out until the washing drum has been operated at all previously selected different target rotational speeds n1-nx and the vibration movement values s1-sx associated with these target rotational speeds have been determined.

In the next step, the values s1-sx are compared and the highest value for s is ascertained. This value is associated with a target rotational speed n which thus represents the optimal target rotational speed for the respective load for the greatest possible mechanical effect on the laundry. The washing drum may then be operated at this target rotational speed.

The vibration system movement values are determined, the frequency and/or amplitude of the vibration system movements being measured by the drive moment, the water level and/or the movements of the vibration system being monitored in a one-dimensional, two-dimensional or three dimensional manner.

As already mentioned, the vibration system movement is measured by sensors, sensors already present in a washing machine also being able to be used. The sensors may measure movements in a one-dimensional, two-dimensional or even three-dimensional manner. Preferably those vibration system movements of the vibration system are determined which have a greater frequency than the respective target rotational speed n.

A particular advantage of the invention is that the sensor unit already present may be used for the method according to the invention. Suitable sensors are path sensors, acceleration sensors or water level sensors which are already used, for example, for measuring the load and the like. Examples of specific sensors are load sensors, three-dimensional path sensors or similar pressure sensors.

In addition to determining the vibration system movement, the fluctuation in the actual rotational speed may also be used for calculating the optimal target rotational speed. It is known that in conventional washing machine drive motors, if they are operated at a fixed target rotational speed of around 55 $min^{-1}$, the driven laundry has an effect on the respective actual rotational speed, according to whether laundry is driven by the entrainers or individual laundry items fall down from above. In the former case, the drum slows down slightly during this rotational section as the laundry items pressed by the entrainers against the washing drum wall displace the center of gravity of the drum. While the laundry items fall down, the drum may be accelerated again during the short rotational section. Most conventional washing machines are already provided with speed regulators which counteract this phenomenon. However, it may be measured and may therefore also act as an indicator of the washing mechanics, and be incorporated in the calculation of the optimal target rotational speed. It is also possible to measure vibration system movements via the motor control unit. In this case, for example, the motor current may be measured.

As the vibration system movement is detected over a specific time period Δts, a plurality of measuring points may be combined into one value, or a continuous measurement may be carried out.

A further aspect of the present invention is a washing machine comprising a washing drum which is mounted in a vibration system and a programmable control unit, to which a control program is assigned, which defines the method of the present invention. For example, the predetermined target rotational speeds may be set via such a control unit or a program may be defined which previously determines the application rotational speed and then selects suitable target rotational speeds.

BRIEF DESCRIPTION OF THE DRAWINGS

The invention is described in more detail now with reference to the accompanying drawing, in which:

The FIGURE shows a schematic front cross-sectional view of a washing machine with the vibration system located therein.

DETAILED DESCRIPTION OF EXEMPLARY EMBODIMENTS OF THE PRESENT INVENTION

FIG. 1 shows in cross section a washing machine 1 in front view. The washing drum 2 comprising entrainers 3 and the detergent solution container 4 located around said washing drum may be seen. The detergent solution container 4 is suspended on four spring elements 6, which are additionally provided on the underside with dampers 8. The washing drum 2, the detergent solution container 4 and the spring elements 6 form the vibration system 10. The drum 2 is driven by the drive 16. Sensors 12 are provided for measuring movements of the vibration system. Also shown is a control element 14 which may control the implementation of the method of the present invention. Laundry items a, b, c are located in the washing drum shown 2.

At a first rotational speed n1, the laundry items a, b and c in the washing drum 2 perform a rolling motion (not shown), the drum 2 rotating very slowly, so that the laundry items a, b, and c are not lifted upwards by the entrainers 3 but merely positioned around one another in layers in the lower region of the drum 2.

At a slightly faster rotational speed n2, the entrainers 3 drive individual laundry items and carry them over a specific rotational section. This is shown for the laundry item b. At a specific point, the laundry item falls down again due to the force of gravity. This is shown for the laundry item c. The rotational speed n2 is in this case the rotational speed for optimal mechanical input.

At an even higher rotational speed n3, the laundry items would already be pressed slightly more heavily against the drum wall due to the centrifugal force and individual laundry items would already bear against the wall. Depending on the load, at this rotational speed it may still arise that individual laundry items will fall down, but laundry items are also present which do not fall down during a complete revolution. This rotational speed is thus already too high for optimal mechanical input.

LIST OF REFERENCE NUMERALS

1 Washing machine
2 Washing drum
3 Entrainer
4 Detergent solution container
5 Entrainer
6 Spring elements
8 Damper
10 Vibration system
12 Sensor
14 Control element
16 Drive
a, b, c Laundry items

The invention claimed is:

1. A washing machine comprising:
a washing drum mounted in a vibration system;
a drive that drives the washing drum at two different target rotational speeds below an application rotational speed for a predetermined time period, wherein the application rotational speed is a speed where laundry is forced against the drum wall by centrifugal forces;
a sensor that measures a movement of the vibration system at each target rotational speed; and
a programmable controller programmed to:
drive the washing drum at two different target rotational speeds below the application rotational speed for one respective predetermined time period;
measure a vibration system movement value due to a falling action of the laundry at each target rotational speed using the sensor; and
compare the vibration system movement values with one another, ascertain a highest vibration system movement value, and ascertain an optimal target rotational speed which is associated with the highest vibration system movement value.

2. A method for determining a target rotational speed below an application rotational speed of a washing drum of a laundry treatment device having a drive and a vibration system, a dependence of a respective mechanical effect on laundry located in the washing drum on the respective target rotational speed of the washing drum being used to ascertain the target rotational speed at which the mechanical effect is at the greatest, comprising:
driving the washing drum at two different target rotational speeds below the application rotational speed for one respective predetermined time period, wherein the application rotational speed is a speed where the laundry is forced against the drum wall by centrifugal force;
measuring a vibration system movement value due to a falling action of the laundry at each target rotational speed using a sensor; and
comparing the vibration system movement values with one another, ascertaining a highest vibration system movement value, and ascertaining an optimal target rotational speed which is associated with the highest vibration system movement value.

3. The method of claim 2, further comprising ascertaining the respective mechanical effect at the respective target rotational speed by measuring movements of the vibration system which exhibit greater frequency than the respective target rotational speed.

4. The method of claim 2, further comprising measuring the frequency or amplitude of the vibration system movements, by monitoring the drive moment, the water level or the movements of the vibration system in a one-dimensional, two-dimensional, or three-dimensional manner.

5. The method of claim 3, wherein the measuring of the vibration system movements take place via a path sensor, an acceleration sensor, a pressure sensor, or a water level sensor.

6. The method of claim 3, further comprising carrying out a laundry treatment process at the optimal target rotational speed.

7. The method of claim 6, wherein the carrying out of the laundry treatment process comprises a washing or rinsing process.

8. The method of claim 6, wherein the driving and measuring are carried out at three target rotational speeds.

9. The method of claim 6, wherein the driving and measuring are carried out at four target rotational speeds.

10. The method of claim 3, further comprising selecting rotational speeds in the range of between 35 $min^{-1}$ and 75 $min^{-1}$ as the target rotational speeds.

11. The method of claim 10, wherein the selecting of the rotational speeds select the values 35 $min^{-1}$, 55 $min^{-1}$ and 75 $min^{-1}$ as target rotational speeds.

* * * * *